US009828555B2

(12) United States Patent
Irudayaraj et al.

(10) Patent No.: US 9,828,555 B2
(45) Date of Patent: Nov. 28, 2017

(54) DEASPHALTING PROCESS FOR PRODUCTION OF FEEDSTOCKS FOR DUAL APPLICATIONS

(71) Applicant: INDIAN OIL CORPORATION LTD., Kolkata, West Bengal (IN)

(72) Inventors: Devotta Irudayaraj, Faridabad (IN); Naduhatty Selai Raman, Faridabad (IN); Brijesh Kumar, Faridabad (IN); Santanam Rajagopal, Faridabad (IN)

(73) Assignee: INDIAN OIL CORPORATION LTD., Kolkata (IN)

( * ) Notice: Subject to any disclaimer, the term of this patent is extended or adjusted under 35 U.S.C. 154(b) by 183 days.

(21) Appl. No.: 14/347,467

(22) PCT Filed: Oct. 29, 2012

(86) PCT No.: PCT/IB2012/055959

§ 371 (c)(1),
(2) Date: Mar. 26, 2014

(87) PCT Pub. No.: WO2013/064954

PCT Pub. Date: May 10, 2013

(65) Prior Publication Data

US 2014/0238903 A1 Aug. 28, 2014

(30) Foreign Application Priority Data

Nov. 3, 2011 (IN) ..... 1411/KOL/2011

(51) Int. Cl.
*C10G 21/30* (2006.01)
*C10G 21/00* (2006.01)
*C10G 21/28* (2006.01)

(52) U.S. Cl.
CPC ..... *C10G 21/28* (2013.01); *C10G 21/003* (2013.01); *C10G 21/30* (2013.01); *C10G 2300/206* (2013.01); *C10G 2300/4006* (2013.01); *C10G 2300/4056* (2013.01); *C10G 2300/44* (2013.01); *C10G 2400/10* (2013.01)

(58) Field of Classification Search
CPC ..... C10G 21/003; C10G 21/28; C10G 21/30; C10G 2300/206; C10G 2300/4006; C10G 2300/4056; C10G 2300/44; C10G 2400/10
See application file for complete search history.

(56) References Cited

U.S. PATENT DOCUMENTS

| | | | | |
|---|---|---|---|---|
| 2,729,589 | A | 1/1956 | Waghorne et al. | |
| 3,627,675 | A | 12/1971 | Ditman et al. | |
| 3,975,396 | A | 8/1976 | Bushnell et al. | |
| 3,998,726 | A | 12/1976 | Bunas et al. | |
| 4,101,415 | A | 7/1978 | Crowley | |
| 4,191,639 | A | 3/1980 | Audeh et al. | |
| 4,396,493 | A | 8/1983 | Eilers et al. | |
| 4,502,944 | A | 3/1985 | Nelson | |
| 4,747,936 | A | 3/1988 | Penning | |
| 5,024,750 | A | 6/1991 | Sughrue et al. | |
| 5,076,909 | A | 12/1991 | Overfileld | |
| 5,346,615 | A | 9/1994 | Savastano | |
| 6,303,842 | B1 | 10/2001 | Bridges et al. | |
| 2004/0084351 | A1* | 5/2004 | Mashiko | C10G 21/003 208/211 |
| 2006/0118463 | A1* | 6/2006 | Colyar | C10G 67/00 208/86 |

FOREIGN PATENT DOCUMENTS

EP 1 365 006 A1 11/2003

OTHER PUBLICATIONS

Clifford, R. et al. (2007). Dictionary of Energy and Fuels, Whittles, 368 pgs [Office action cites p. 192].*
Schaschke, C. et al. (2014). Dictionary of Chemical Engineering, OUP, 448 pgs [Office action cites p. 223].*

* cited by examiner

*Primary Examiner* — Brian McCaig
(74) *Attorney, Agent, or Firm* — Maschoff Brennan

(57) ABSTRACT

The invention concerns with improved and more flexible deasphalting process for production of lube oil base stock as well as feed stock for secondary processes depending on requirement from heavy residual hydrocarbon oil containing saturates, aromatics, resins and asphaltenes etc by contacting the oil with a solvent comprising of hydrocarbon containing two to six carbon atoms, preferably LPG having C3-C4 hydrocarbons and mixture thereof at predetermined deasphalting conditions wherein the yield of deasphalted oil including its quality is controlled by varying the deasphalting conditions including the operating temperature. The yield variations of 15 to 60 wt % is achieved by swinging the temperature by about 10-20° C. within the operative temperature range of 70-130° C. keeping the rest of the operating conditions including solvent to feed ratio same. The LPG solvent can be recovered using supercritical mode of operation using technology known in the art and recycled.

11 Claims, No Drawings

DEASPHALTING PROCESS FOR PRODUCTION OF FEEDSTOCKS FOR DUAL APPLICATIONS

FIELD OF THE INVENTION

The present invention relates to an improved and flexible process for deasphalting of asphaltene containing heavy residuum oil. In particular, it concerns with deasphalting of heavy residual oil containing saturates, aromatics, resins, asphaltenes alongwith sulphur, nitrogen and metals to obtain Deasphalted Oil (DAO). The deasphalted oil may be either used as feedstock for Lube Oil Base Stock (LOBS) or as feedstock for secondary cracking processes.

BACKGROUND AND PRIOR ART OF THE INVENTION

Solvent deasphalting is a process that separates heavy hydrocarbon oil into two phases, an asphalt phase, which contains substances of relatively low hydrogen to carbon ratio often called asphaltene type materials and a deasphalted oil phase, which contains paraffinic type material substances of relatively high hydrogen to carbon ratio often called Deasphalted Oil (DAO). Therefore, it may be said that solvent deasphalting is possible because different compounds have different solution affinity for each other and some combination are completely miscible while other combinations are almost immiscible. The ability of solvent to distinguish between high carbon to hydrogen asphaltene type and low carbon to hydrogen paraffinic type materials is termed as selectivity.

Solvent deasphalting of heavy residual hydrocarbon oils using solvents to remove contaminant such as asphaltenes, metals and sulphur constituents has long been a standard processing practice in the petroleum refining industry. In the era of high crude oil prices, refiners prefer to process cheaper heavier crude. The large residue generated from heavy crude can be upgraded through solvent deasphalting process to produce DAO for secondary processes.

Solvent deasphalting of short residue is primarily being employed for LOBS production. However, the process also employed to produce more feedstock for secondary conversion processes such as Fluid Catalytic Cracking (FCC) and hydrocracking so as to upgrade bottom of the barrel and improve distillate yield.

Conventionally, Propane deasphalting is predominantly used for production of LOBS feedstock and slightly heavier paraffinic solvents are used for production of feedstock for conversion process. Propane deasphalting produces high quality DAO suitable for LOBS production with limited DAO yield while use of heavier solvent say, $C_5$ hydrocarbons results in increased DAO yield at the cost of quality. Thus, the choice of solvent for deasphalting is made based on the requirement of DAO yield and rejection level of contaminants leading to requirement of two different processing units.

The use of light hydrocarbon to upgrade heavy hydrocarbon oils is the subject of many patents, for instance U.S. Pat. No. 4,502,944, U.S. Pat. No. 4,747,936, U.S. Pat. No. 4,191,639 U.S. Pat. No. 3,975,396, U.S. Pat. No. 3,627,675, U.S. Pat. No. 2,729,589 which are incorporated herein by reference. Use of mixture of propane, $CO_2$, $H_2S$ is reported in U.S. Pat. No. 4,191,639 and an increase in DAO yield for same quality is also reported.

In U.S. Pat. No. 3,975,396, deasphalting with 3 carbon atom solvent such as propylene and acetone is reported.

U.S. Pat. No. 2,729,589 reports that lowering of solvent molecular weight by inclusion of methane and ethane resulted in poorer plant performance. It is also found that optimum plant performance, in term of entrainment of asphaltene in deasphalted oil and color of deasphalted oil, is with 14% butane deasphalting solvent. U.S. Pat. No. 5,346,615 reports a process for deasphalting and demetalization of crude and its fraction with organic carbonates in liquid phase. The above described prior arts deal with multiple solvents.

A contacting apparatus for introducing high molecular weight solvent at the top and lower molecular weight solvent at the bottom and feed in between with agitation is reported in U.S. Pat. No. 3,627,675.

U.S. Pat. No. 4,747,936 describes an improved deasphalting and demetalization of heavy oil to produce Demetalised Oil (DMO) as feedstock for secondary cracking processes such as hydrocracking or Fluid catalytic cracking processes and not intended to produce LOBS which requires high selectivity.

U.S. Pat. No. 4,502,944 describes mixing of process material with solvent and introducing into first separator where separation of asphaltene-rich heavy first fraction and a resin-rich intermediate fraction separated by first interface is achieved. In the same separator, a first light faction separated from the intermediate fraction by second interface is formed. The first light fraction from the first separator is introduced into a second separator maintained at a temperature above the critical temperature of the solvent to separate second heavy fraction rich in oil and second light fraction rich in solvent, which is recycled to mixing zone.

In U.S. Pat. No. 3,998,726, concurrent extraction is described in which a third stream is withdrawn between top and bottom streams and the stream is heated and introduced between third and top streams.

Separation of paraffinic oil fraction, resin fraction and asphalt fraction in two stage solvent extraction is reported in U.S. Pat. No. 4,101,415.

Integration of deasphalting with catalytic conversion has also been subject of several patents, U.S. Pat. No. 6,303,842, U.S. Pat. No. 4,396,493, U.S. Pat. No. 5,024,750, etc. These prior arts deal with specific single mode operation either LOBS mode or fuel mode operation, thus lacking flexibility.

The above prior arts for deasphalting heavy hydrocarbon oils are found to be either using multiple and rather costly solvents or require complex units. Further, the methods are set to produce feedstocks for either secondary cracking process or lubricant oil base stock production but not both. Further, the said prior arts do not deal with any variation of DAO yield with quality as per requirement. Thus, there is a genuine need to develop an improved deasphalting method which does not suffer from the above problems.

OBJECTS OF THE INVENTION

The main object of the present invention is to provide an improved and flexible deasphalting process which can produce deasphalted oil with lower Conradson Carbon Residue (CCR) and higher saturates to aromatics ratio suitable for LOBs production say, lube mode and also feedstock with acceptable CCR and saturates to aromatics ratio for secondary process say, feed mode as per requirement.

Another object of the invention is to provide an improved process for achieving both lube and feed mode with a single and preferably cheaper solvent.

Still another object of the invention is to provide a deasphalting process using refinery produced cheaper solvent such as LPG instead of costly propane, butane or pentane individually.

Still another object of the present invention is to provide a deasphalting process which is capable of operating in a single commercial unit for both modes of operation.

Still another object of the invention is to provide a deasphalting process using a solvent that can be recovered and recycled.

Still another object of the invention is to facilitate increase in throughput by reducing the solvent to feed ratio.

DETAILED DESCRIPTION OF THE INVENTION

According to the present invention there is provided an improved process for deasphalting heavy residual hydrocarbon oil comprising contacting the oil with a hydrocarbon solvent containing two to six carbon atoms in a single extraction apparatus at predetermined deasphalting conditions to produce a deasphalted oil product phase (containing paraffinic type materials of relatively high hydrogen to carbon ratio) and asphalt product phase (containing substances of relatively low hydrogen to carbon ratio), separating out the deasphalted oil product phase and isolating the deasphalted oil (DAO) therefrom wherein the yield of the deasphalted oil including its quality as measured by the contaminants level present therein is controlled by varying the deasphalting conditions. The deasphalted oil may be either used as feedstock for Lube Oil Base Stock (LOBS) or as feedstock for secondary cracking processes.

LOBS Feedstock:

For LOBS feedstock, the deasphalting oil should have low Conradson Carbon Residue (CCR) and higher saturates to aromatics ratio, where the aromatics include resins and asphaltenes also. The CCR for LOBS feedstock of about 2 wt % and the high saturates to aromatics ratio is necessary to meet the viscosity index requirement of resulting lubricating oil.

Feedstock for Secondary Cracking Processes:

While the DAO suitable for LOBS can also be used as feedstock for secondary cracking processes, it is desirable to have higher yield of DAO, to get more distillates from residue through cracking processes. However, the extent of removal of contaminants essentially depends on the yield of DAO as higher DAO yield is achieved at the cost of quality of deasphalted oil, that is, lowering saturates to aromatics ratio and higher level of contaminants like CCR, metals. The yield of DAO needs to be optimized depending upon the acceptable level of quality. Since majority of metals and contaminants are removed in asphalt, the resulting Deasphalted Oil (DAO) is a better feedstock for cracking processes in terms of catalyst life and makeup.

The yield of deasphalted oil in the process can be controlled by varying the deasphalting conditions while the solvent composition is kept fixed.

The invented process uses readily available refinery produced solvent comprising preferably Liquified Petroleum Gas (LPG) for achieving dual process applications for obtaining feedstock with lower Conradson Carbon Residue (CCR) and high saturates to aromatics ratio suitable for lube base oil production and also feedstock with acceptable CCR and saturates to aromatics ratio for secondary cracking processes. The liquified petroleum gas solvent contains hydrocarbons with 3 to 6 carbon atoms, preferably 3 to 5 carbon atoms, more preferably with 3 and 4 carbon atoms. The deasphalting conditions include the options of the state of pressure, temperature and solvent to feed ratio. In one embodiment of the invention one of the deasphalting conditions is the option of the state of operating temperature which may be required to vary in the ranges between 70-130° C., preferably, 90-120° C. when other parameters of deasphalting conditions are fixed in order to obtain desired deasphalted oil either as a feedstock for lube base oil production or feedstock for secondary cracking processes.

The yield of deasphalted oil depends on the solvent power of the solvent used in the deasphalting process. The solvent power or the solubility of the oil depends on the surface tension of the deasphalting solvent. As the surface tension of the solvent increases, the solubility of the oil increases resulting in higher yield of deasphalted oil. Propane has lower surface tension compared to higher light paraffinic hydrocarbons like, $C_4$, $C_5$ and LPG and hence results in lower DAO yield. The surface tension of the solvent can be manipulated either by changing the solvent or by changing the temperature. In the present invention, the surface tension of the solvent is increased by using liquefied petroleum gas to achieve higher yield of deasphalted oil in one mode of operation while with the same solvent, surface tension is countered by increasing the temperature of operation in another mode of operation to achieve low solubility of oil. In both the modes of operation, the solvent to feed ratio is lower as compared to propane process. Propane process operated at such lower solvent to feed ratio would lead to improper phase separation and very low DAO yield. Also propane process cannot be operated at higher temperature as employed in the LPG process, as it will be close or above the critical temperature of propane. However, butane and its higher homologues say, pentane, hexane, heptane can be operated at lower solvent to feed ratio as well as at higher temperature leading to higher DAO yield but production of LOBS feedstock with acceptable CCR and higher saturates to aromatics ratio is not feasible due to poor selectivity.

The advantage of the present invention allows for retrofitting existing commercial equipment. An additional advantage of deasphalting with liquefied petroleum gas as solvent in the present invention is a product produced in the refinery. Hence, separation of pure solvent say, propane for use in deasphalting unit is not required leading to significant energy savings. Another advantage is that the solvent can be recovered under supercritical mode in a commercial unit. The present process gives variable yield and quality and hence improves the utility of the unit with a single solvent. For achieving higher DAO yield of about 30 to 60 wt % with propane, solvent to feed ratio or S/F ratio should be very high or the temperature should be very low. High S/F ratio will not only put severe restriction on the extractor throughput but also will increase the cost of utilities for solvent recovery. Decrease in temperature say, from the normally operating temperature of about 60-70° C. for propane, will be impractical considering the high viscosity of residue at lower temperature, which decreases the mass transfer coefficient substantially. Higher yield say, 30 to 60 wt % with acceptable CCR and saturates to aromatics ratio can be achieved with butane and pentane as solvent.

According to the invention the yield of deasphalted oil can be optionally controlled at 15 to 60 wt % on feed for a fixed solvent by varying the deasphalting conditions. Relatively higher percentage of yield of deasphalted oil is obtained at a lower operating temperature or vice versa under given deasphalting conditions. In one embodiment the deasphalted oil is obtained at 15 to 30 wt % yield with lower Conradson Carbon Residue of 1.5 to 2.5 wt % and relatively higher saturates to aromatics ratio from 0.4 to 0.7 suitable for lubricant oil base stock production. In another embodiment, the deasphalted oil is obtained at 30-60 wt % yield with relatively higher but acceptable Conradson Carbon Residue of 2.5 to 6 wt % and low saturates to aromatics ration in the range of 0.15 to 0.4 suitable as a feedstock for secondary cracking processes. In a specific embodiment, the deasphalting oil with different yields and quality suitable for both the applications is achieved by varying only the operating temperature. The deasphalted oil yield variation of 15 to 60 wt % can be achieved by swinging the temperature by about 10-20° C. within the operating temperature range of 70-130° C. preferably in the range of 90-120° C. keeping rest of the deasphalting conditions including solvent to feed ratio same.

The dosage of solvent used can be in the range of 200-800 vol %, preferably in the range of 300-500 vol % of feed. Another preferred embodiment of the invented deasphalting process involves recovery of the solvent from the deasphalted oil phase by supercritical mode to save energy on solvent recovery using technology known in the art. The recovered solvent can be recycled in the process. According to this invention the heavy residual hydrocarbon oil contains saturates, aromatics, resins, asphaltenes along with sulphur, nitrogen and metals. In another embodiment it is Short Residue (SR) to generate more distillates for cracking processes. The invented process can be performed in a batch or continuous counter current extraction.

DESCRIPTION OF THE INVENTION WITH REFERENCE TO THE EXAMPLES WITH PREFERRED EMBODIMENTS

Feedstock

The invented process is applied to short residue as the feedstock oil. The feedstock may typically comprise hydrocarbons having initial boiling point of greater than 450° C. Typical properties of short residue are presented in Table 1. The feed has CCR of 21.5% and the metal content viz. Nickel and Vanadium are 34 and 61 ppm, respectively. The hydrocarbon components, namely, saturates, aromatics, resins and asphaltenes (SARA) is also provided.

TABLE 1

Typical properties of Short Residue (SR)

| S.No | Properties | Result |
|---|---|---|
| 1 | Density | 1.017 gm/cc |
| 2 | Conradson Carbon Residue | 21.5 wt % |
| 3 | Nickel | 34 ppm |
| 4 | Vanadium | 61 ppm |
| 5 | Sulphur | 4.8 wt % |
| 6 | Nitrogen | 2510 ppm |
| 7 | Saturates | 5.9 wt % |
| 8 | Aromatics | 56.0 wt % |
| 9 | Resins | 22.5 wt % |
| 10 | Asphaltenes | 15.6 wt % |
| 11 | Saturates to Aromatics ratio | 0.06 |

Solvent

The process of the present invention involves the use of liquefied petroleum gas solvent containing component from a group of solvents viz., C3 and C4 hydrocarbon but preferably n-propane to n-pentane and its isomers. The typical composition of straight run of liquefied petroleum gas solvent is given in Table 2.

TABLE 2

Typical Composition of Liquefied Petroleum Gas

| S.No. | Component | Wt % |
|---|---|---|
| 1 | Propane | 25-35 |
| 2 | Butane | 65-75 |
| 3 | Iso-butane | 2-5 |
| 4 | Pentane | 0.5-1.0 |

Solvent Deasphalting

The deasphalting experiments were carried out in the laboratory scale high pressure Liquid-liquid equilibrium set up. Known quantity of hot short residue is charged into the set up followed by known quantities of solvent (LPG) from separate bomb. The content is stirred for two hours at a constant mixing temperature maintained with the help of external circulation of heating fluid. The constant stirring of 500 rpm is maintained in all the experiments. After two hours of mixing, the stirring is stopped and contents are allowed to settle at the same temperature for three hours. The asphalt and DAO phases were carefully separated and the products were analyzed for different important properties of interest after evaporating the solvent.

Example: I

For each deasphalting experiment, liquid-liquid equilibrium extraction was performed in lab scale jacketed extraction apparatus (batch). The feed (short residue) was preheated. The feed (about 300-500 g), properties of which is given in Table 1, and solvent are fed into the extraction apparatus. The temperature of the equilibrium setup is kept constant. The feed and solvent were mixed well using a stirrer. The stirrer speed is kept constant throughout the mixing time. The mixing time is kept around 120 minutes. After mixing the content, it is kept around 3 hr for complete phase separation (settling). After settling of phases, the two phases were separated accurately and collected separately. The phases were weighed accurately with precision balance to ensure material balance. The solvent free DAO and asphalt products were weighed and the DAO yield was obtained based on feed. Final DAO samples were analyzed for various properties. The results from the experimental studies are shown in the Table 3. From the table, it can be seen that the DAO is about 20 wt % with saturates content of 35.9 wt % suitable as LOBS feedstock.

TABLE 3

Typical operating condition for a lube mode operation and properties of the deasphalted oil

| Deasphalting Conditions | |
|---|---|
| Temperature | 118° C. |
| Solvent to feed ratio | 4.0 (vol./vol.) |
| **Properties of DAO** | |
| Deasphalted Oil yield | 20.1 wt % |
| Conradson Carbon Residue | 2.0 wt % |
| Saturates | 35.9 wt % |
| Saturate to Aromatics Ratio | 0.55 |

Example: II

For each deasphalting experiment, liquid-liquid equilibrium extraction was performed in lab scale jacketed extraction apparatus (batch). The feed (Short residue), properties of which is given in Table 1, was preheated. The feed and the solvent whose composition is same as in Example 1 are fed into the extraction apparatus. The temperature of the equilibrium setup is kept constant. The feed and solvent were mixed well using a stirrer. The stirrer speed is kept constant throughout the mixing time. The mixing time is kept around 120 minutes. After mixing the content, it is kept around 3 hr for complete phase separation (settling). After settling of phases, the two phases were separated accurately and collected separately. The phases were weighed accurately with precision balance to ensure material balance. The solvent free DAO and asphalt products were weighed and the DAO yield was obtained based on feed. Final DAO samples were analyzed for various properties. The results from the experimental studies are shown in the Table 4. It can be seen from the table that the DAO yield is about 41 wt % and the contaminants have been reduced substantially from that of short residue. Further, the higher DAO yield have been achieved with the same solvent composition but with different temperature used in Example 1, where the DAO yield is about 20 wt %.

TABLE 4

Typical operating condition for a fuel mode operation and properties of the deasphalted oil

| Deasphalting Conditions | |
|---|---|
| Temperature | 105° C. |
| Solvent to feed ratio | 4.0 (vol/vol) |
| **Properties of DAO** | |
| Deasphalted Oil yield | 41 wt % |
| Conradson Carbon Residue | 6.9 wt % |
| Nickel | 3.0 ppm |
| Vanadium | 4.8 ppm |
| Sulphur | 3.4 wt % |
| Saturates | 18.1 wt % |
| Saturate to aromatics ratio | 0.22 |

The embodiments of the invention disclosed herein are only illustrative in nature and there can be other several possible embodiments as would be apparent from the practice of the invention. The full scope and spirit of the invention should be derived from the following appended claims.

We claim:

1. A process for deasphalting heavy residual hydrocarbon oil, resulting in dual mode operation comprising:

a) subjecting the oil to solvent deasphalting with LPG as solvent, in a single extraction apparatus at predetermined deasphalting conditions to produce a deasphalted oil product phase and an asphalt product phase, b) while maintaining a deasphalting temperature in the range of 70 to 130° C., changing the deasphalting temperature between approximately 10 and 20° C. within said range, thereby obtaining said deasphalted oil product phase that includes a deasphalted oil having conradson carbon residue (CCR) of 1.5 to 2.5 wt % and having saturates to aromatics ratio from 0.4 to 0.7 and another deasphalted oil having conradson carbon residue (CCR) of 2.5 to 6.0 wt % and having saturates to aromatics ratio from 0.15 to 0.4, c) separating out the deasphalted oil product phase and the asphalt product phase, and d) using said deasphalted oil having conradson carbon residue (CCR) of 1.5 to 2.5 wt % and having saturates to aromatics ratio from 0.4 to 0.7 as lubricant oil base stock and said other deasphalted oil having conradson carbon residue (CCR) of 2.5 to 6.0 wt % and having saturates to aromatics ratio from 0.15 to 0.4 as a feedstock for secondary cracking processes.

2. A process as claimed in claim 1, wherein the deasphalting conditions include an option of the state of operating temperature.

3. A process as claimed in claim 1, wherein the yield of deasphalted oil is 15 to 60 wt % of feed.

4. A process as claimed in claim 1, wherein the solvent dosage is in the range of 200-800 vol %.

5. A process as claimed in claim 1, wherein the solvent contains hydrocarbons with 3 to 6 carbon atoms.

6. A process as claimed in claim 1, wherein the heavy residual hydrocarbon oil contains saturates, aromatics, resins, asphaltenes along with sulphur, nitrogen and metals.

7. A process as claimed in claim 1, wherein the solvent is recovered using supercritical operation and recycled after recovery.

8. A process as defined in claim 7, wherein the solvent contains hydrocarbons with 3 and 5 carbon atoms.

9. A process as defined in claim 7, wherein the solvent contains hydrocarbons with 3 and 4 carbon atoms.

10. A process as defined in claim 1, wherein the deasphalting temperature is in the range of 90-120° C.

11. A process as claimed in claim 1, wherein the solvent dosage is in the range of 300-500 vol % of feed.

* * * * *